United States Patent [19]

Iida

[11] 4,123,902

[45] Nov. 7, 1978

[54] EXHAUST PORT LINER FOR MULTI-CYLINDER INTERNAL COMBUSTION ENGINE

[75] Inventor: Hiroshi Iida, Tokyo, Japan

[73] Assignee: Nissan Motor Company, Ltd., Japan

[21] Appl. No.: 675,626

[22] Filed: Apr. 9, 1976

[30] Foreign Application Priority Data

Apr. 11, 1975 [JP] Japan ..... 50/44011

[51] Int. Cl.[2] ..... F01N 3/10

[52] U.S. Cl. ..... 60/282; 123/193 H

[58] Field of Search ..... 60/272, 282, 322, 323; 123/191 A, 193 H

[56] References Cited

U.S. PATENT DOCUMENTS

| | | | |
|---|---|---|---|
| 2,257,631 | 9/1941 | Wahlberg | 60/323 |
| 3,969,893 | 7/1976 | Sakurai | 60/282 |
| 4,031,699 | 6/1977 | Suga | 123/193 H |

FOREIGN PATENT DOCUMENTS

| | | | |
|---|---|---|---|
| 2,323,793 | 11/1974 | Fed. Rep. of Germany | 60/282 |

*Primary Examiner*—Douglas Hart

[57] ABSTRACT

A multi-cylinder internal combustion engine includes, per each of a plurality of cylinders, a main combustion chamber, an auxiliary combustion chamber in which ignition is effected by means of a spark plug and a torch nozzle through which a torch flame resulting from combustion within the auxiliary combustion chambers enters the main combustion chamber to initiate combustion therein. An engine head of the engine has a plurality of exhaust passageways, corresponding in number to half of the plurality of cylinders. Each of the plurality of exhaust passageways has a discharge port, to which an exhaust manifold is connected, and extends from the discharge port to two of exhaust valves which are arranged next to each other. Within each of the plurality of exhaust passageways, a port liner is installed to keep exhaust gas flowing along the exhaust passageway warm.

2 Claims, 5 Drawing Figures

EXHAUST PORT LINER FOR MULTI-CYLINDER INTERNAL COMBUSTION ENGINE

BACKGROUND OF THE INVENTION

The present invention relates to a multi-cylinder internal combustion engine, and more particularly to an internal combustion engine fitted with a thermal reactor in its exhaust system.

In order to reduce pollutants, such as nitrogen oxides (NOx), carbon monoxide (CO) and hydrocarbons (HC), from motor vehicle propelled by an internal combustion engine, a conventional internal combustion engine for motor vehicles has a main combustion chamber to which a lean air-fuel mixture is supplied, an auxiliary combustion chamber to which a rich air-fuel mixture is supplied and in which ignition of the rich air-fuel mixture is effected by means of a spark plug and a torch nozzle connecting the auxiliary combustion chamber to the main combustion chamber to allow a torch flame into the main combustion chamber to initiate combustion of the lean air-fuel mixture therein. With this combustion arrangement lean combustion with relatively low peak combustion temperatures is possible and formation of nitrogen oxides is suppressed and besides exhaust gas resulted from the combustion is sufficiently oxygen rich for self-oxidation of carbon monoxide and hydrocarbons in the exhaust gas, so that if temperature of the exhaust gas is kept sufficiently high enough, oxidation will occur. For enabling the self-oxidation of carbon monoxide and hydrocarbons of the exhaust gas, an exhaust manifold of the internal combustion engine includes a thermal reaction chamber in a central portion thereof and thermally insulated manifold passages leading from an engine head to the thermal reaction chamber. However, the conventional internal combustion engine has a disadvantage that thermal gradient along an exhaust port passage formed in the engine head is great and this may minimize or eliminate reaction within the thermal reaction chamber.

SUMMARY OF THE INVENTION

A main object of the present invention is to provide a multi-cylinder internal combustion engine in which heat transfer from exhaust gas from a plurality of exhaust valves toward an engine head of the engine is minimized.

A specific object of the present invention is to provide a multi-cylinder internal combustion engine which has an engine head formed with a plurality of exhaust port passages along which exhaust gas flows with minimum heat loss.

BRIEF DESCRIPTION OF THE DRAWINGS

The present invention will be specifically described hereinafter with reference to the accompanying drawings, in which.

DESCRIPTION OF THE PREFERRED EMBODIMENTS

Figure 1:
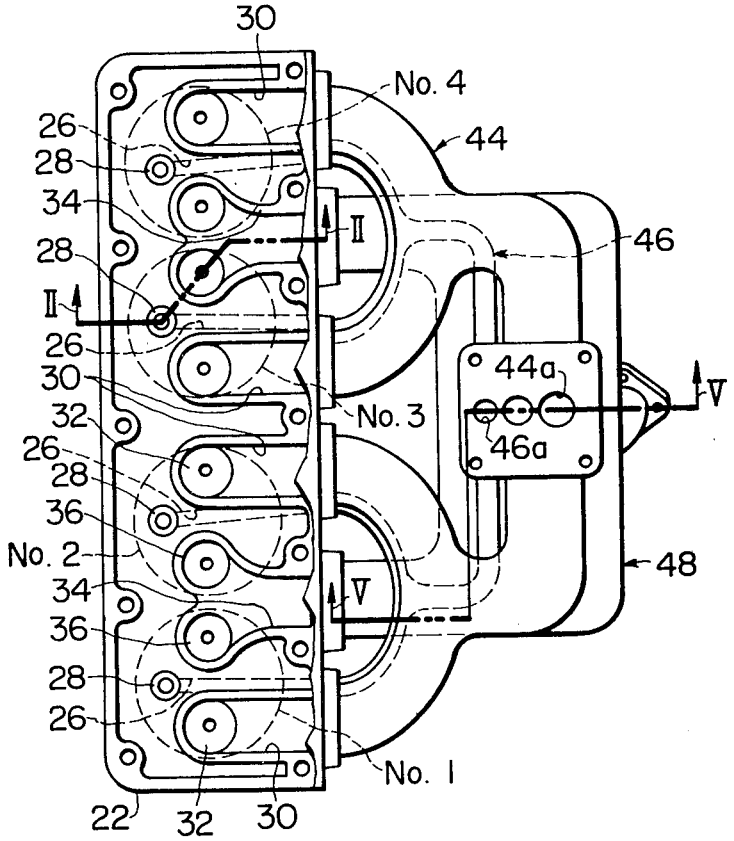
FIG. 1 is a diagrammatic plan view of a multi-cylinder internal combustion engine embodying the present invention.

Referring more specifically to the drawings in which similar reference characters are employed to designate similar parts, the invention is shown as applied to a four-cylinder internal combustion engine of the type including an auxiliary combustion chamber associated with each main combustion chamber and connected by a torch nozzle. The engine which is generally designated at 10 comprises an engine block 12 which is provided with the usual cooling liquid passageways 14 and cylinders 16. Reciprocably slidable within respective cylinders are pistons 18 connected to a crank shaft (not shown). Provided above each piston 18 is a main combustion chamber 20. Formed within an engine head 22 are auxiliary combustion chambers 24, each being connected to one main combustion chamber 20 by way of a torch nozzle 25. The engine head 22 is provided with transversely extending auxiliary intake port passages 26 each communicating with each auxiliary combustion chamber 24 under the control of an auxiliary intake valve 28. The head 22 is also provided with transversely extending main intake port passages 30, each being communicable with the main combustion chambers 20 under the control of main intake valves 32, respectively, and with exhaust port passages 34, each extending downwardly and inwardly to the region of two exhaust valves 36 of cylinder numbers 1 and 2 or of cylinder numbers 3 and 4 (see FIG. 1) and being communicable with the main combustion chambers 20. As will be readily understood from FIG. 1, the exhaust valves 36 of each pair of the adjacent cylinders are arranged next to each other to reduce the length as measured along each exhaust port passage 34 from an exhaust port intake end thereof **34*a* to an exhaust discharge end thereof 34*b*. It will be noted that since each of the exhaust port passages 34 leads to adjacent two exhaust valves, amount of exhaust gases flowing through the exhaust port passage 34 becomes approximately twice as much as that of exhaust gases flowing through a conventional exhaust passageway which leads to one of the exhaust valves, thus effectively keeping each exhaust passage 34 warm to reduce thermal gradient along flow path from each exhaust intake and 34*a* to the exhaust discharge end thereof 34*b*. Thus drop of temperature of the exhaust gases at the discharge end 34*b*** is small.

Figure 2:
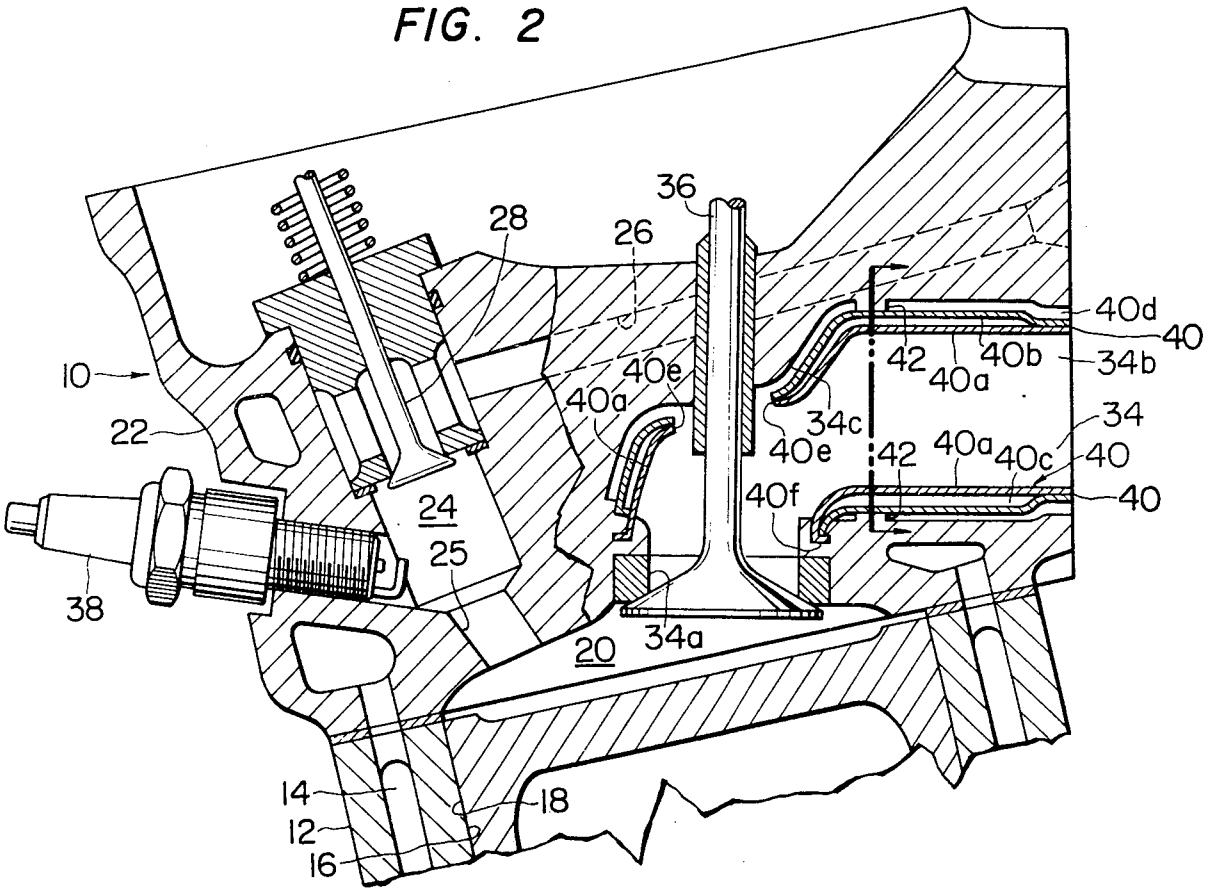
FIG. 2 is a sectional, somewhat enlarged and fragmentary view taken through line II—II shown in FIG. 1, showing one example of a port liner installed in one of exhaust passageways.

To reduce the thermal gradient more effectively, a port liner is fixedly mounted, by casting, within the exhaust port passage 34 to eliminate direct contact of the exhaust gases with the inner wall **34*c* of the port passage 34 (see FIG. 2**).

Referring now to FIG. 2 there is shown a fragmentary and enlarged sectional view of the engine as taken through line II—II in FIG. 1, in which a spark plug 38 has its electrode projecting into the auxiliary combustion chamber 24 to ignite the rich air-fuel mixture within the auxiliary combustion chamber 24 to eject a torch flame through the torch nozzle 25 into the main combustion chamber 20 to initiate combustion of the lean air-fuel mixture therein. The port liner, which is now generally designated as 40, has dual metal tubes **40*a* and 40*b* of a suitable thin metal, such as a thin stainless steel, which are partly spaced to provide therebetween an air space 40c. With a plurality of spacers 42, the outer metal tube 40b is spaced from the inner wall 34c to provide therebetween another air space 40d. It will be noted that the air spaces 40c and 40d serve as insulators. The port liner 40 is formed with two apertures, only one being shown in FIG. 2 and designated as 40e, to permit valve guide sleeves of the adjacent two exhaust valves 36 to extend therethrough. The outer and inner metal tubes 40a and 40b are interconnected at areas around the apertures 40e to form edges defining these apertures 40e, respectively, thereby sealing the air space 40c. The dual metal layers of the port liner 40 are closed at ends 40e as shown in FIG. 2. To hold the port liner 40 in the proper position as illustrated in FIG. 2, the inner metal tube 40a has at areas adjacent to exhaust intakes thereof outwardly projecting radial flanges 40f, only one being shown, which are embedded into the engine head 22. As will be understood from FIG. 2, each of the port liners 40 has exhaust intakes thereof disposed adjacent to exhaust intake ends 34a of the corresponding one of the exhaust port passages 34 and an exhaust discharge thereof disposed adjacent exhaust discharge end 34b of the exhaust port passage, and outer and inner metal tubes 40a and 40b are interconnected at areas adjacent to the exhaust intakes and at an area adjacent to the exhaust discharge, thereby sealing the air space 40c therebetween. The port liner 40 is cast into the engine head 22 and during this casting operation molding sand formed around the port liner 40 acts as a core. After the casting operation is completed, the molding sand is removed to provide the air layer 40d**.

Figure 3:
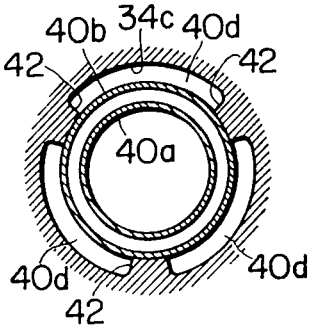
FIG. 3 is a sectional view taken through line III—III shown in FIG. 2.

Although in FIGS. 2 and 3 the spacers 42 are formed integrally with body of the engine head and made of the same material, such spacers may be formed integrally on the outer peripheral surface of the outer metal layer 40b, if desired.

It will now be noted that since the outer metal tube 40b is supported in spaced relation with the inner wall 34c with the plurality of spacers 42, the heat loss through the inner wall 34c is minimized. It will also be noted that, during casting operation moulding sand will not enter the air layer 40c because the air layer 40c is sealed.

Figure 4:
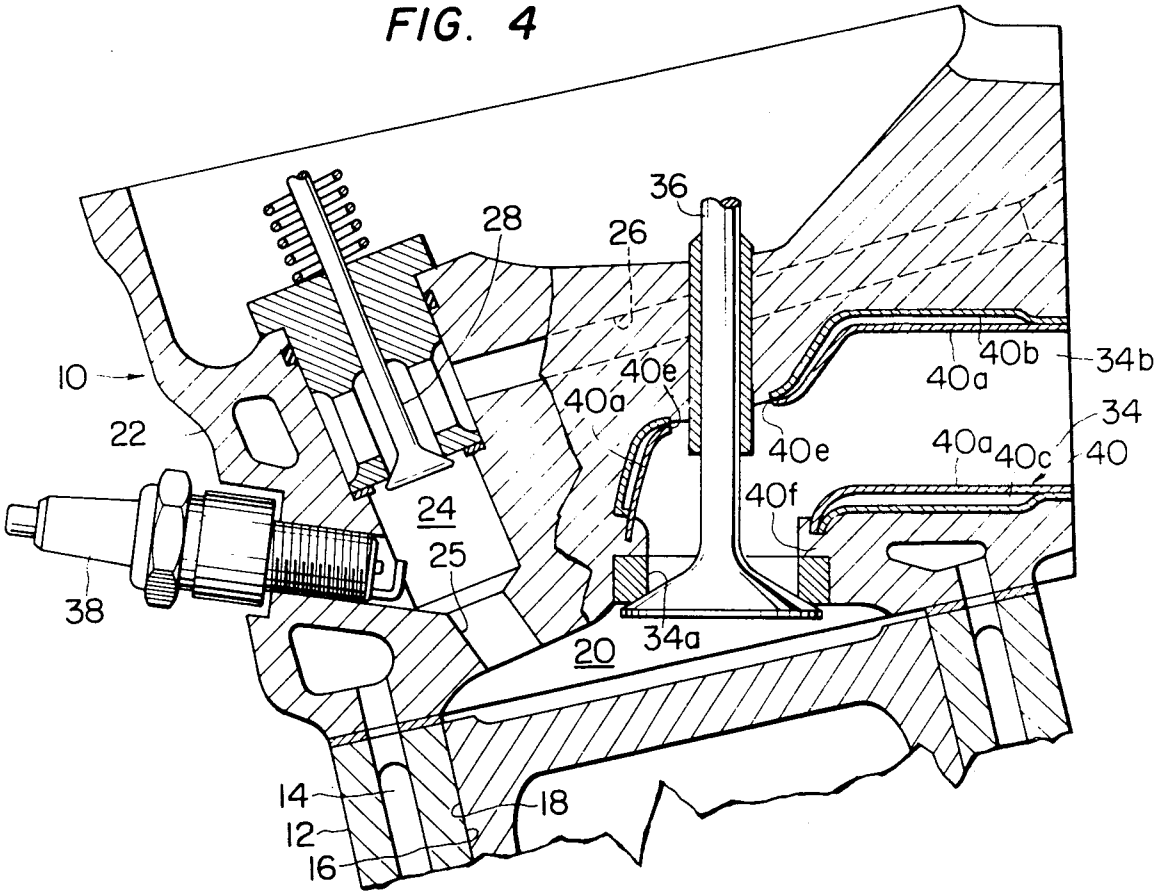
FIG. 4 is a similar view to FIG. 2 showing a second example of a port liner installed in one of exhaust passageways.

The embodiment shown in FIG. 4, although basically similar to the preceding embodiment, is different therefrom in that an outer metal tube 40b of a port liner 40 contacts with an inner wall 34c without any space therebetween, thus eliminating the air space 40d provided in the preceding embodiment shown in FIG. 2. Another minor difference resides in that the flange 40f is not necessary in the embodiment shown in FIG. 4.

It will be noted that since each of the exhaust port passages 34 formed in the engine head extends toward the adjacent two exhaust valves 36 to receive exhaust gases from both of the adjacent two cylinders and is port liners 40, formed by dual metal tubes, are fixedly mounted within the port passages 34, respectively in order to prevent exhaust gases from contacting with exhaust port passage defining walls, and, therefore, thermal gradient along each of the exhaust port passages is minimized.

It will be noted that since in FIG. 4 embodiment the outer metal tube 40c of port liner 40 is fixedly mounted within an exhaust port passage 34 without any space between the outer metal tube 40c and the exhaust port passage defining wall, it is not necessary to form molding sand around the port liner 40 when casting the port liner 40 into the engine cylinder, thus eliminating the step of removing sand, which is otherwise necessary as in the case of FIG. 2 embodiment, after the casting operation is completed.

It will be noted that since an air space 40c, which acts as an insulator, is formed between outer and inner metal tubes 40a and 40b, removing of molding sand around the outer metal tube 40a after casting operation is completed, in the case of FIG. 2 embodiment, is not so difficult because distance between the outer metal tube 40a and exhaust port passage defining wall can be made narrow.

It will also be noted that because a port liner 40 is made of dual metal tubes 40a and 40b, the rigidity of the port liner is increased and deformation during casting operation is reduced.

Figure 5:
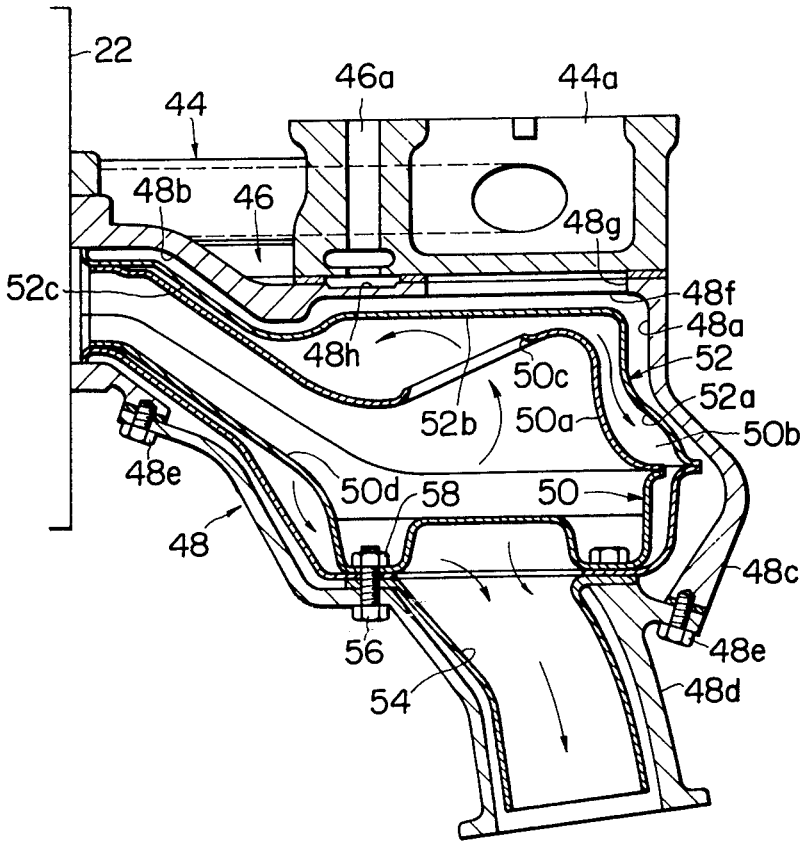
FIG. 5 is a diagrammatic sectional view taken through line V—V shown in FIG. 1.

Referring to FIG. 5 there is shown a longitudinal section through line V—V of the manifold system shown in FIG. 1. The manifold system includes a main intake manifold 44 with a heat riser 44a, an auxiliary intake manifold 46 with a heat riser 46a and an exhaust manifold 48 which is of the self-supporting type. The main and auxiliary intake manifolds 44 and 46 are mounted by their heat risers 44a and 46a on a central portion 48a of the exhaust manifold 48 and extend toward the engine head 22 to meet all the main inake port passages 30 and all the auxiliary intake port passages 26, respectively, to distribute a lean air-fuel mixture to the main combustion chambers 20 and a rich air-fuel mixture to the auxiliary combustion chambers 24. The exhaust manifold 48 has manifold passages 48b extending outwardly from the central portion 48a to the engine head 22 to meet the exhaust port passages 34 formed within the engine head 22 so as to receive hot exhaust gases from the discharge ends 34b of the exhaust passageways 34.

Casing of the exhaust manifold 48 is made of a cast iron and for facilitating the installation of an inner layer 50 and an outer layer 52 within the manifold passages 48b and the central chamber 48a, the casing is assembled with an upper part 48c and a lower prt 48d by means of a plurality of suitable bolts 48e. The upper part 48c has a flat wall 48f with an aperture 48g and with a recess 48h and attached on the flat wall 48f through a gasket are the heat riser 44a with the bottom arranged in alignment with the aperture 48g and the heat riser 46a with the recess 48h as its bottom (see FIG. 5).

The outer layer 52, preferably of a suitable metal, such as a thin stainless, has an insulating chamber 52a, a heater wall 52b positioned in a face-to-face relation with the bottom of the riser 44a and the bottom of the recess 48h and a plurality of sleeves 52 extending outwardly from the insulating chamber 52a. The insulating chamber 52a is positioned in the central chamber 48a and the sleeves 52c are positioned in the manifold passages 48b, respectively.

The inner layer 50, preferably made of a suitable metal, such as a thin stainless, has a reaction chamber 50a within the insulating chamber 52a and spaced therefrom to form an annular space 50b therebetween which communicates with the reaction chamber 50a through an aperture 50c and also with an outlet port 54 for connection to the exhaust pipe. Extending outwardly from the reaction chamber 50a and extending through the sleeves 52c are tubular portions, only one being shown and designated as 50d, to convey the exhaust gases from the discharge ports 34b (see FIG. 2 or 4) to the reaction chamber 50a.

The annular space 50*b* should be so designed and the aperture 50*c* and the discharge port 54 are so arranged with respect to the space 50*b* that the exhaust gases discharged from the aperture 50*c* will flow toward the heater wall 52*b* to heat the same and flow the outer surface of the reaction chamber 50*a* all over before entering the port 54 to keep the reaction chamber 50*a* warm (see solid arrows in FIG. 5).

It is to be noted that the aperture 50*c* is arranged on the remote and opposite sides of the reaction chamber 50*b* to the side adjacent to a portion where the discharge port 54 is provided to increase the residence time of the exhaust gases, thus promoting oxidation of hydrocarbon (HC) in the exhaust gases.

It is also to be noted that the heater wall 52*b* is exposed to flow of exhaust gases from the aperture 50*c* and positioned adjacent to and directly below the heat risers 44*a* and 46*a* to effectively heat the intake mixtures therein to promote fuel vaporization.

If it is necessary to increase heat transfer to the heat risers 44*a* and 46*a*, the flat wall 52*b* may be formed with aperture means (not shown) to direct the exhaust gases toward the bottom of the heat riser 44*a* and the bottom of the recess 48*h*.

The construction of the manifold system described in the preceding enables better fuel vaporization of the intake mixtures and ensures stable creation of a torch flame.

In the exhaust manifold 48 the inner and outer layers 50 and 52 are attached to the lower part 48*d* of the casing by means of a bolt 56 and a nut 58 in such a manner that their centers of gravity align with each other, increasing the durability of the exhaust manifold 48.

It will now be appreciated from the preceding description that according to the present invention, the exhaust gases discharged from the exhaust valves 36 are maintained at elevated temperature in the exhaust system and the residence time of the exhaust passages in the exhaust system is increased. As a result, the noxious components of the exhaust gases are oxidized well before being discharged from the exhaust system.

Although in the embodiments the invention is applied to the internal combustion engine having an auxiliary combustion chamber associated with each main combustion chamber and connected by a torch nozzle in which a rich air fuel mixture within the auxiliary combustion chamber is ignited by a spark plug to eject a torch flame into the main combustion chamber, by way of the torch nozzle, to initiate combustion of a lean air-fuel mixture therein, the invention may be applied to internal combustion engines as far as the combustion therein will discharge oxygen rich exhaust gases.

What is claimed is:

1. A multi-cylinder internal combustion engine system comprising:

an engine block having at least two cylinders;

a plurality of pistons slidably disposed in said cylinders respectively, for reciprocal movement;

an engine head securely attached to said engine block to close said cylinders and cooperating therewith to form a plurality of main combustion chambers within said cylinders, respectively;

said engine head having a plurality of auxiliary combustion chambers connected to said plurality of main combustion chambers, respectively, by respective nozzles which are formed within said engine head;

means for supplying a lean air-fuel mixture to the main combustion chamber during the induction stroke of each of said pistons, which is formed within the cylinder having therein said each piston and a rich air-fuel mixture to the auxiliary combustion chamber connected to said main combustion chamber;

a spark plug having its electrode exposed to each of said auxiliary combustion chambers to ignite the rich air-fuel mixture therein thereby to cause a torch flame to propagate through the nozzle toward the main combustion chamber to initiate combustion of the lean air-fuel mixture therein;

said engine head having an exhaust port passage which has two exhaust intake ends opening to said main combustion chambers, respectively, an exhaust discharge end and a wall defining said exhaust port passage;

a port liner fixedly mounted by casting within said exhaust port passage and having two exhaust intakes adjacent to said exhaust intake ends, respectively, and an exhaust discharge adjacent to said exhaust discharge end;

exhaust valve means for closing each of said exhaust intake ends, said exhaust valve means having a valve guide sleeve projecting into said exhaust port passage and a valve member cooperating with one of said exhaust intake ends, said valve member having a stem slidable extending through said valve guide sleeve;

said port liner having two apertures for permitting said valve guide sleeves to extend, respectively;

said port liner having a multiple walled construction formed by at least two metal tubes which are partially spaced from each other to form a continuous space therebetween, said space surrounding substantially all areas on the outer surfaces of an inner one of said metal tubes, said metal tubes being joined at areas adjacent to said exhaust intakes, at areas adjacent to the edges of said apertures, and at an area adjacent to said exhaust discharge thereby to close said space, said port liner being cast into said engine head when assembled, said port liner having an end portion at each of said exhaust intakes thereof which is embedded into said engine head, said two metal tubes being joined with each other at the area adjacent to said exhaust discharge of said port liner, in which said outermost metal tube and said wall defining said exhaust port passage cooperate with each other to form another space surrounding the outer surface of said outermost metal tube, in which said another space is continuous, and in which said another space communicates with an exhaust flow passage defined by said inner metal tube through said apertures.

2. A multi-cylinder internal combustion engine system comprising:

an engine block having at least two cylinders;

a plurality of pistons slidably disposed in said cylinders, respectively, for reciprocal movement;

an engine head securely attached to said engine block to close said cylinders and cooperating therewith to form a plurality of main combustion chambers within said cylinders, respectively;

said engine head having a plurality of auxiliary combustion chambers connected to said plurality of main combustion chambers, respectively, by respective nozzles which are formed within said engine head;

means for supplying a lean air-fuel mixture to the main comcombustion chamber during the induction stroke of each of said pistons, which is formed within the cylinder having therein said each piston and a rich air-fuel mixture to the auxiliary combustion chamber connected to said main combustion chamber;

a spark plug havng its electrode exposed to each of said auxiliary combustion chambers to ignite the rich air-fuel mixture therein thereby to cause a torch flame to propagate through the nozzle toward the main combustion chamber to initiate combustion of the lean air-fuel mixture therein;

said engine head having an exhaust port passage which has two exhaust intake ends openng to said main combustion chambers, respectively, an exhaust discharge end and a wall defining said exhaust port passage;

a port liner fixedly mounted by casting within said exhaust port passage and having two exhaust intakes adjacent to said exhaust intake ends, respectively, and an exhaust discharge adjacent to said exhaust discharge end;

exhaust valve means for closing each of said exhaust intake ends, said exhaust valve means having a valve guide sleeve projecting into said exhaust port passage and a valve member cooperating with one of said exhaust intake ends, said valve member having a stem slidable extending through said valve guide sleeve;

said port liner having two apertures for permitting said valve guide sleeves to extend, respectively;

said port liner having a multiple walled construction formed by at least two metal tubes which are partially spaced from each other to form a continuous space therebetween, said space surrounding substantially all areas on the outer surfaces of an inner one of said metal tubes, said metal tubes being joined at areas adjacent to said exhaust intakes, at areas adjacent to the edges of said apertures and at an area adjacent to said exhaust discharge thereby to close said space, said port liner being cast into said engine head when assembled, said port liner having an end portion at each of said exhaust intakes thereof which is embedded into said engine head, the end portion of said port liner at each of said exhaust intakes of said port liner terminating in an outwardly extending flange, said engine head having a plurality of spacer portions projecting inwardly into said exhaust port passage, an outermost one of said two metal tubes having areas which are fixed, by casting, to said spacer portions, said two metal tubes being joined with each other at the area adjacent to said exhaust discharge of said port liner, said last-mentioned joined area being spaced radially inwardly from said wall defining said exhaust port passage, in which said outermost metal tube and said wall defining said exhaust port passage cooperate with each other to form another space surrounding substantially all area on the outer surface of said outermost metal tube, in which said another space is continuous, and in which said another space communicates with an exhaust flow passage defined by said inner metal tube through said apertures.

* * * * *